US006966285B1

(12) United States Patent
Sun

(10) Patent No.: US 6,966,285 B1
(45) **Date of Patent: *Nov. 22, 2005**

(54) ENGINE VALVE ACTUATION CONTROL AND METHOD

(75) Inventor: Zongxuan Sun, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/963,672

(22) Filed: Oct. 13, 2004

Related U.S. Application Data

(60) Provisional application No. 60/589,691, filed on Jul. 21, 2004.

(51) Int. Cl.[7] ..... F01L 9/02

(52) U.S. Cl. ..... 123/90.12; 123/90.15; 123/90.11; 251/29; 251/30.01; 251/129.03; 137/625.34; 137/625.39; 137/625.64; 91/459; 91/529

(58) Field of Search ..... 123/90.12

(56) References Cited

U.S. PATENT DOCUMENTS

| | | | | |
|---|---|---|---|---|
| 5,456,222 | A | 10/1995 | Schechter | |
| 5,638,781 | A | 6/1997 | Sturman | |
| 6,109,284 | A | 8/2000 | Johnson et al. | |
| 6,263,842 | B1 | 7/2001 | DeOjeda et al. | |
| 6,739,293 | B2 * | 5/2004 | Turner et al. | 123/90.12 |
| 6,837,196 | B2 * | 1/2005 | Sun | 123/90.12 |
| 6,886,510 | B2 * | 5/2005 | Sun et al. | 123/90.12 |

OTHER PUBLICATIONS

SAE Technical Paper 1999-01-0825; "Digital Valve Technology Applied to the Control of an hydraulic Valve Actuator", Kathleen M. Misovec, Bruce G. Johnson, Gary Mansour, Oded E. Sturman and Steven Massey, Detroit MI, Mar. 1-4, 1999.

SAE Technical Paper 2002-02-1109, "Production Electro-Hydraulic Variable Valve-Train for a New Generation of I.C. Engines", Jeff Allen and Don Law, Detroit, MI, Mar. 4-7, 2002.

SAE Technical Paper 2004-01-1265, "Design and Control of a Two-Stage Electro-hydraulic Valve Actuation System", Christopher W. Turner, Guy R. Babbit, Christopher S. Balton, Miguel A. Raimao and Daniel D Giodano, Detroit, MI, Mar. 8-11, 2004.

* cited by examiner

*Primary Examiner*—Thomas Denion
*Assistant Examiner*—Kyle M. Riddle
(74) *Attorney, Agent, or Firm*—Kathryn A. Marra

(57) ABSTRACT

A valve actuator control monitors engine valve trajectory, lift and seating velocity and varies the timing of internal feedback control channels to correct for engine valve positioning errors to achieve precise engine valve lift, closing timing and desired seating velocity.

10 Claims, 5 Drawing Sheets

ENGINE VALVE ACTUATION CONTROL AND METHOD

CROSS-REFERENCE TO RELATED APPLICATIONS

This application claims priority from U.S. Provisional Patent Application No. 60/589,691 filed Jul. 21, 2004.

TECHNICAL FIELD

This invention relates to engine valve trains and, more particularly, to a control and method for an electrohydraulic valve actuator for an internal combustion engine.

BACKGROUND OF THE INVENTION

Valve actuators for camless valve trains of internal combustion engines have been proposed in the art. Such valve trains are often controlled with algorithms which have limited bandwidth. However, due to changes in engine operating conditions, such as thermal expansion and speed transient, such algorithms offer low repeatability from cycle to cycle and cylinder to cylinder and sometimes do not provide full capability of variable lift.

It is desirable to provide a hydraulic engine valve actuator control that adapts to changes in engine operating conditions to provide precise valve lift and satisfactory seating velocity over a wide range of conditions. It is also desirable to provide a valve actuator control having increased flexibility and full capacity for variable lift. Therefore, there is a need in the art to provide a valve actuator control for an engine that meets these desires.

SUMMARY OF THE INVENTION

The present invention provides a valve actuator control which monitors engine valve trajectory, lift and seating velocity and varies the timing of internal feedback control channels to correct for engine valve positioning errors and achieve precise engine valve lift and seating velocity.

A feedforward plus feedback control (FPFC) interfaces with a spool valve operative to control engine valve actuation. The FPFC actuates the spool valve to initiate opening and closing of the engine valve at a desired trajectory. The desired trajectory may vary or remain unchanged from cycle to cycle regardless of the engine speed. If the trajectory remains unchanged, repetitive control can be used as an example of the FPFC.

A learning control (LC) interfaces with first and second on/off valves to activate and deactivate first and second feedback channels to correct lift position error and closing timing error by altering engine valve lift, closing timing and seating velocity.

A sensor tracks engine valve lift, trajectory, velocity and timing and relays the information to the FPFC and/or the LC.

Each cycle, the LC monitors and interprets the valve lift, trajectory, velocity and closing timing to determine lift position error and valve closing timing error and corrects the error by altering the timing of the feedback channels, as needed to correct the error in subsequent valve cycles.

These and other features and advantages of the invention will be more fully understood from the following description of certain specific embodiments of the invention taken together with the accompanying drawings.

DESCRIPTION OF THE PREFERRED EMBODIMENT

Figure 1:
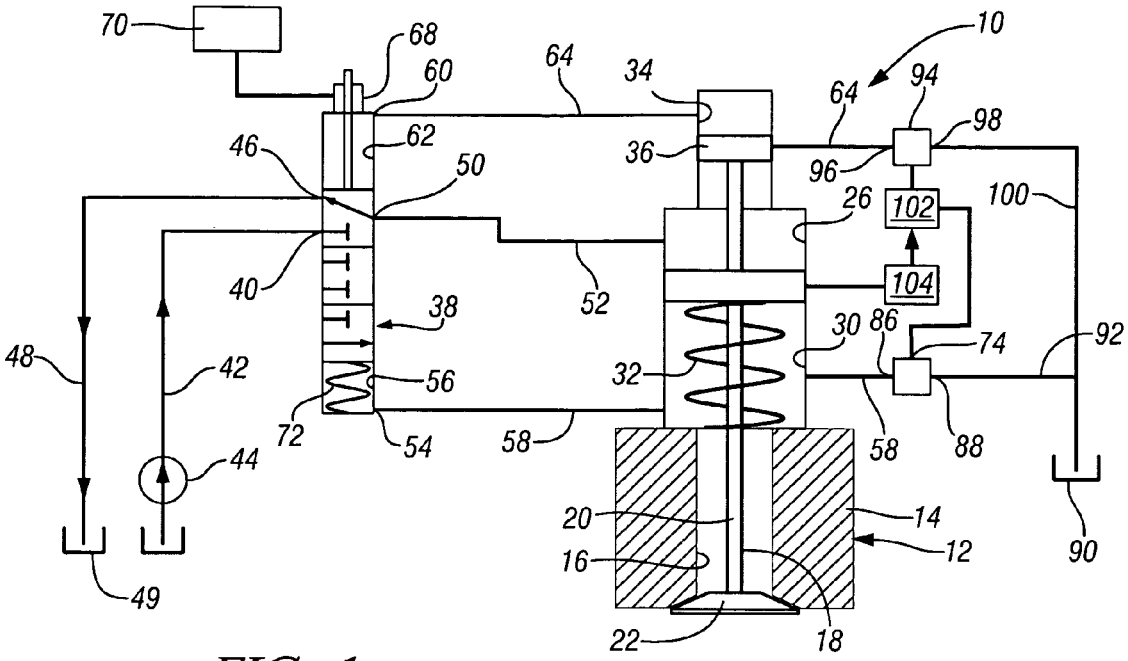
FIG. 1 is a diagrammatic view of a valve actuator assembly, illustrated in operational relationship with an engine of a vehicle.
Figure 2:
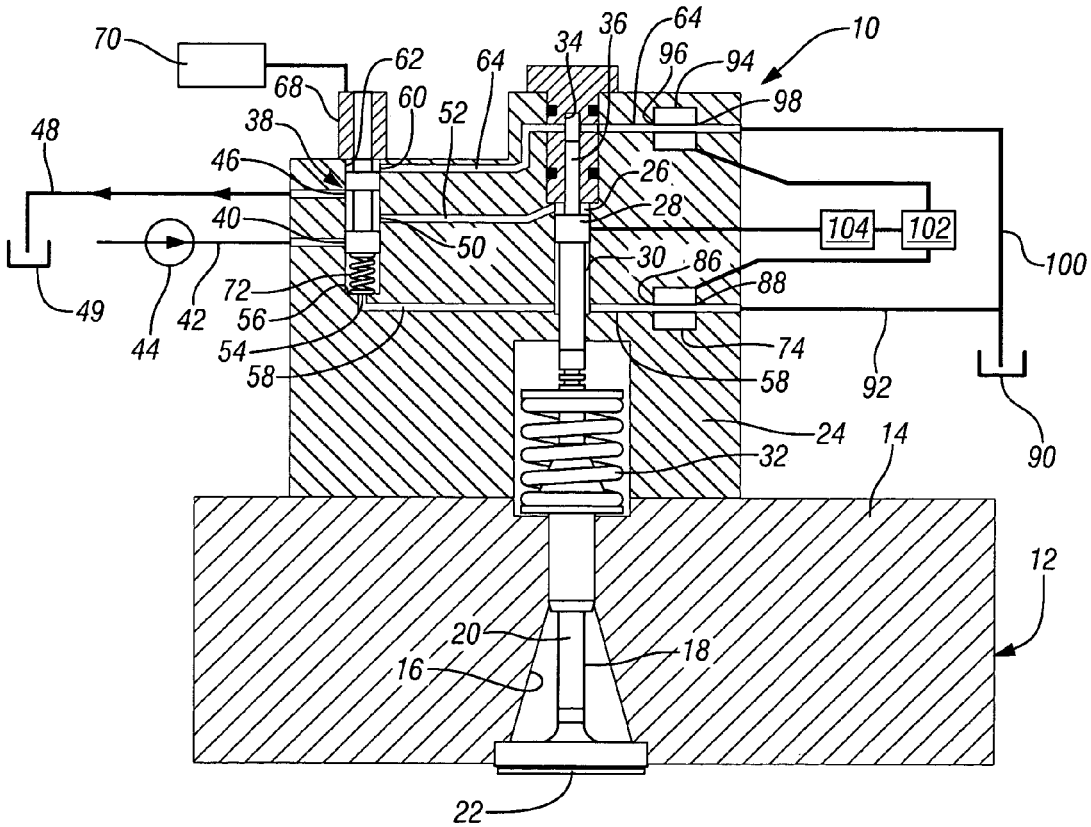
FIG. 2 is a cross-sectional view of the valve actuator assembly of FIG. 1 in an engine valve closed position.

Referring first to FIGS. 1 and 2 of the drawings in detail, numeral 10 generally indicates an exemplary embodiment of an electrohydraulic valve actuator assembly mounted on a cylinder head 12 including at least one opening 16 in communication with an internal combustion chamber, not shown, of the engine. The cylinder head 12 also includes a movable engine valve 18 for each opening 16. The engine valve 18 has a valve stem 20 and a valve head 22 at one end of the valve stem. The engine valve 18 is movable between open and closed positions within its respective opening 16. It should be understood that the engine valve 18 may be either an intake or an exhaust valve.

The valve actuator assembly 10 further includes a valve housing 24 disposed adjacent the cylinder head 12. The valve housing 24 has a main or first fluid chamber 26 therein. A first piston 28 is connected to or in contact with the valve stem 20 of the engine valve 18. The piston 28 is disposed in the first fluid chamber 26 of the valve housing 24 and forms a second fluid chamber 30 therein. An engine valve spring 32 is disposed about the valve stem 20 and contacts the cylinder head 12 to bias the engine valve 18 toward the closed position so that the valve head 22 closes the opening 16, as shown in FIG. 2.

The valve actuator assembly 10 further includes a third fluid chamber 34 axially spaced from the first fluid chamber 26 and defined by the housing 24. A second piston 36, connected to the first piston 28, is disposed in the third fluid chamber 34.

The valve actuator assembly 10 also includes a spool valve 38 fluidly connected to the first fluid chamber 26 of the valve housing 24. The spool valve 38 is of a three position three-way type. The spool valve 38 has a high pressure port 40 fluidly connected by an intermediate channel 42 to a fluid pump 44 and a low pressure port 46 fluidly connected by second intermediate channel 48 to a fluid tank 49. If desired, the fluid pump 44 may be fluidly connected to the fluid tank 49 or a separate fluid tank.

The spool valve 38 further includes a third port 50 fluidly connected by a driving channel 52 to the first fluid chamber 26. The spool valve 38 also has a fourth port 54 fluidly connecting a fourth chamber 56 to the second fluid chamber 30 of the valve housing 24 via a first feedback channel 58 and a fifth port 60 fluidly connecting a fifth chamber 62 via a second feedback channel 64 to the third fluid chamber 34. The spool valve 38 is operable to control fluid flow to and from the first fluid chamber 26.

The spool valve 38 also includes an actuator 68 at one end of the spool valve 38 adjacent the fifth chamber 62. The actuator 68 is of a linear type, such as a solenoid, electrically connected to a source of electrical power, such as a FPFC 70. The FPFC energizes and de-energizes the actuator to actuate the spool valve. This initiates opening and closing of the engine valve at the desired trajectory.

The spool valve 38 further includes a spool valve spring 72 disposed in the fourth chamber 56 to bias the spool valve toward the actuator 68. The FPFC 70 energizes and de-energizes the actuator 68 to move the spool valve 38.

The spool valve spring 72 is operative to bias the spool valve 38 toward the actuator 68 when fluid pressures, in the fourth and fifth chambers 56 and 62 are equal. However, a pressure differential between the fourth or the fifth chambers 56 and 62 may be able to overcome the force of the spool valve spring 72.

The valve actuator assembly 10 further includes a first on/off valve 74 fluidly connected to the second fluid chamber 30 of the valve housing 24. The first on/off valve 74 has first and second ports 86, 88. The first port 86 is fluidly connected by the first feedback channel 58 to the second fluid chamber 30. The second port 88 is fluidly connected to a fluid tank 90 by a low pressure line 92. It should be appreciated that the fluid tank 90 is able to maintain certain level of back pressure to create a low pressure source.

The valve actuator assembly 10 further includes a second on/off valve 94 fluidly connected to the third fluid chamber 34 of the valve housing 24. The second on/off valve 94 has first and second ports 96, 98. The first port 96 is fluidly connected by the second feedback channel 64 to the third fluid chamber 34. The second port 98 is fluidly connected to the fluid tank 90 by a low pressure line 100. If desired, the low pressure line 100 may be fluidly connected to a separate fluid tank, not shown.

A LC 102 interfaces with the first and second on/off valves 74 and 94 to activate and deactivate the first and second feedback channels 58, 64. As a result, the LC is able to adjust the spool valve 38 and thereby control lift and seating velocity of the engine valve 18.

An engine valve sensor 104 interfaces with the LC 102 and monitors engine valve 18 lift, seating velocity, opening and closing velocity, trajectory and timing. If desired, the sensor 104 may also interface with the FPFC 70.

The LC 102 interprets the engine valve information from the sensor 104 and determines if any engine valve errors occurred during the current engine valve cycle, the LC also calculates the proper timing for the feedback channels to correct any errors in a subsequent engine valve cycle.

The LC 102 determines optimal feedback timing using the following equation, $$T_{i+1}=T_i+k*e, \text{ where:}$$

$T_{i+1}$ equals the triggering timing for a subsequent valve event;

$T_i$ equals the triggering timing of the current valve event;

k is a gain; and e is a lift position error or closing timing error.

However, it should be understood that the LC 102 may use variations of the above equation or other suitable equations for calculating the triggering timing of the feedback channels.

In operation, as illustrated by FIG. 2, the engine valve 18 is shown in the closed position. To reach this position, the FPFC 70 de-energizes the actuator 68. This allows the spool valve spring 72 to move the spool valve 38 toward the actuator, closing the high pressure port 40 and opening the low pressure port 46. This communicates the first chamber 26 with the fluid tank 49 via the low pressure port 46 and allows the engine valve spring 32 to keep the engine valve 18 closed with the valve head 22 closing the opening 16.

Figure 3:
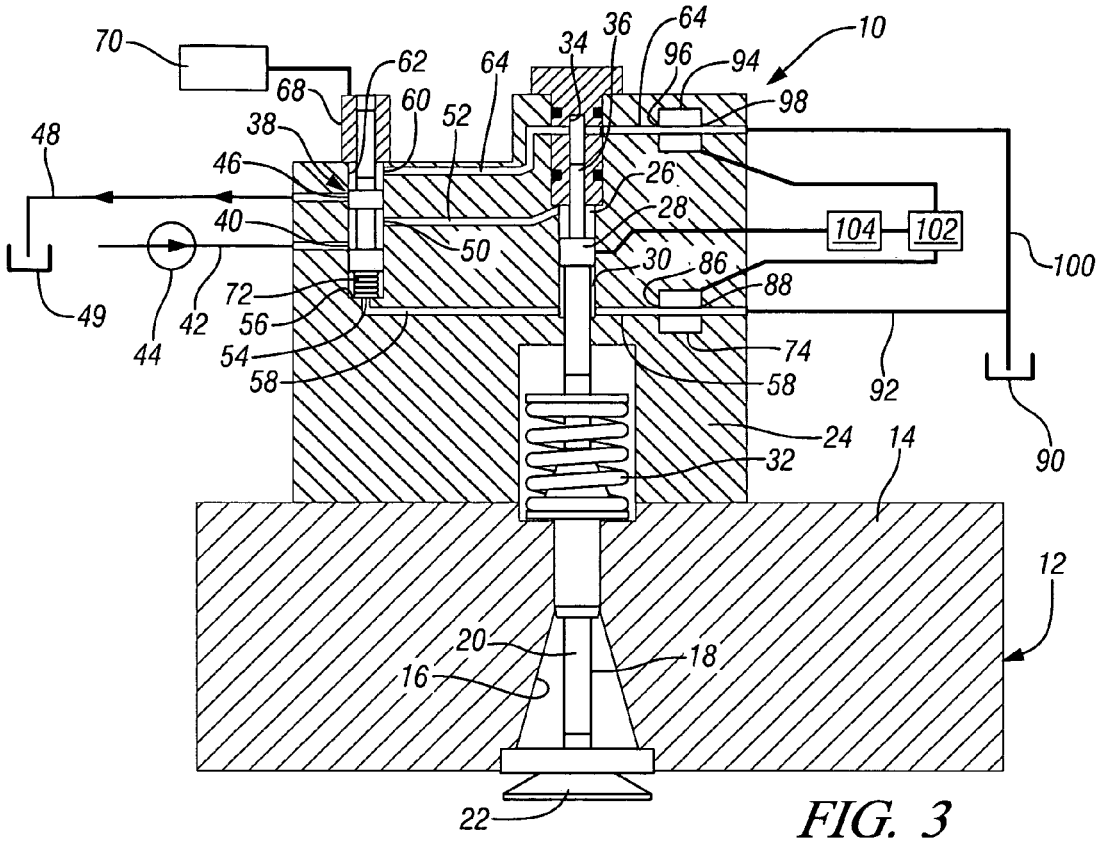
FIG. 3 is a view similar to FIG. 2 in a valve opening position.

To open the engine valve 18, as illustrated in FIG. 3, the FPFC 70 energizes the actuator 68 to drive the spool valve 38 against the spool valve spring 72, closing the low pressure port 46 and opening the high pressure port 40. This allows high pressure fluid to flow from the pump 44 through the spool valve 38 into the first chamber 26. The fluid pressure acts against the first piston 28 to overcome the force of the engine valve spring 32 and open the engine valve 18. During this time the sensor 104 monitors engine valve opening timing, velocity and trajectory and relays this information to the FPFC 70 and the LC 102.

As the engine valve 18 opens, the first piston 28 displaces fluid from the second chamber 30 into the first feedback channel 58. The release of fluid from the first feedback channel 58 to the fluid tank 90 is regulated by the first on/off valve 74. This allows the first on/off valve to control the opening velocity and the lift of the engine valve 18 by restricting fluid flow to the fluid tank 90 to increase the fluid pressure within the second chamber 30, the first feedback channel 58 and the fourth chamber 56 of the spool valve 38. The increased fluid pressure within the fourth chamber 56 drives the spool valve 38 upward against the actuator 68 and into the fifth fluid chamber 62, thereby limiting or temporarily cutting off the connection between the driving channel 52 and the intermediate channel 42. This reduces fluid pressure supplied to the first chamber 26 and slows or stops the opening velocity of the engine valve 18.

Figure 4:
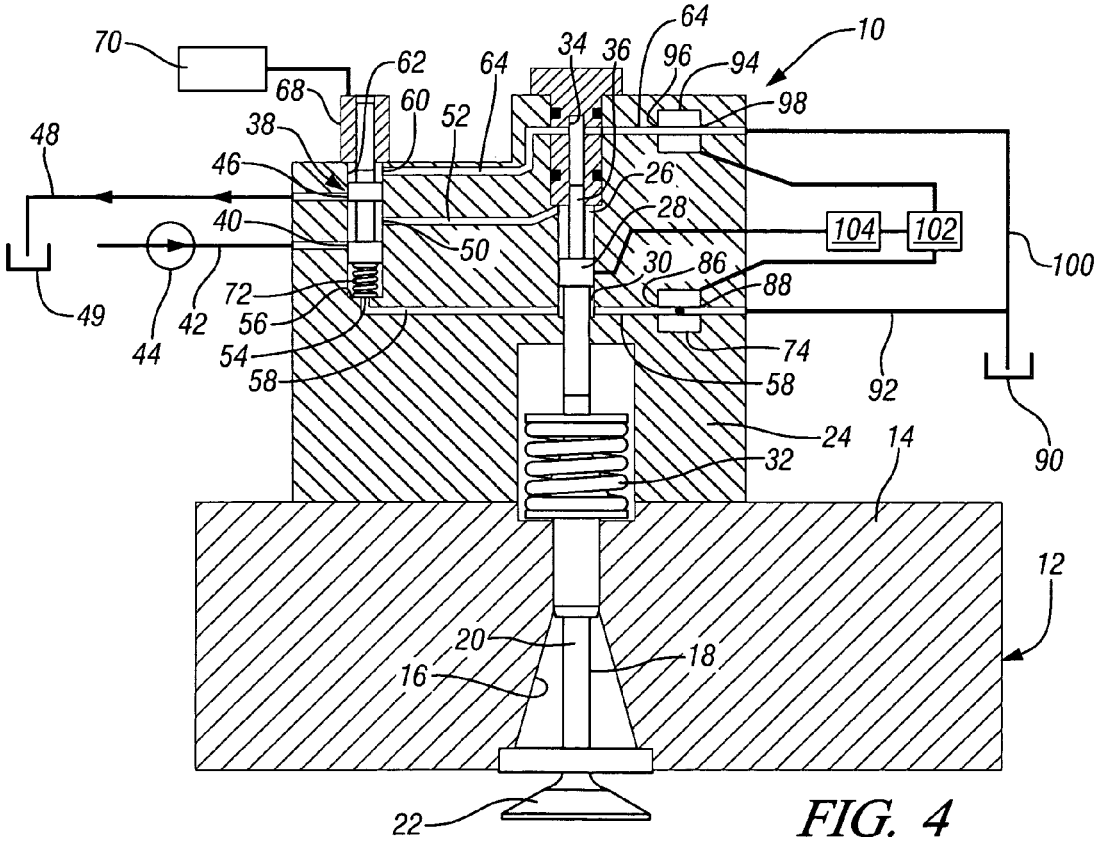
FIG. 4 is a view similar to FIG. 2 in a valve opened position.

To stop the engine valve 18 at a predetermined lift position, as shown in FIG. 4, the LC 102 energizes the first on/off valve 74 to block the flow of fluid to the fluid tank 90 and increase fluid pressure in the fourth chamber 56 of the spool valve 38. The increased pressure moves the spool valve 38 to a neutral position that closes communication between the high and low pressure ports 40, 46 and the third port 50 of the spool valve 38 to seal the first fluid chamber and thereby maintain the position of the first piston 28. The trigger timing of the first on/off valve is determined by the LC 102 and may be varied to alter the amount of engine valve lift or to correct for engine valve lift error in a previous cycle.

Figure 5:
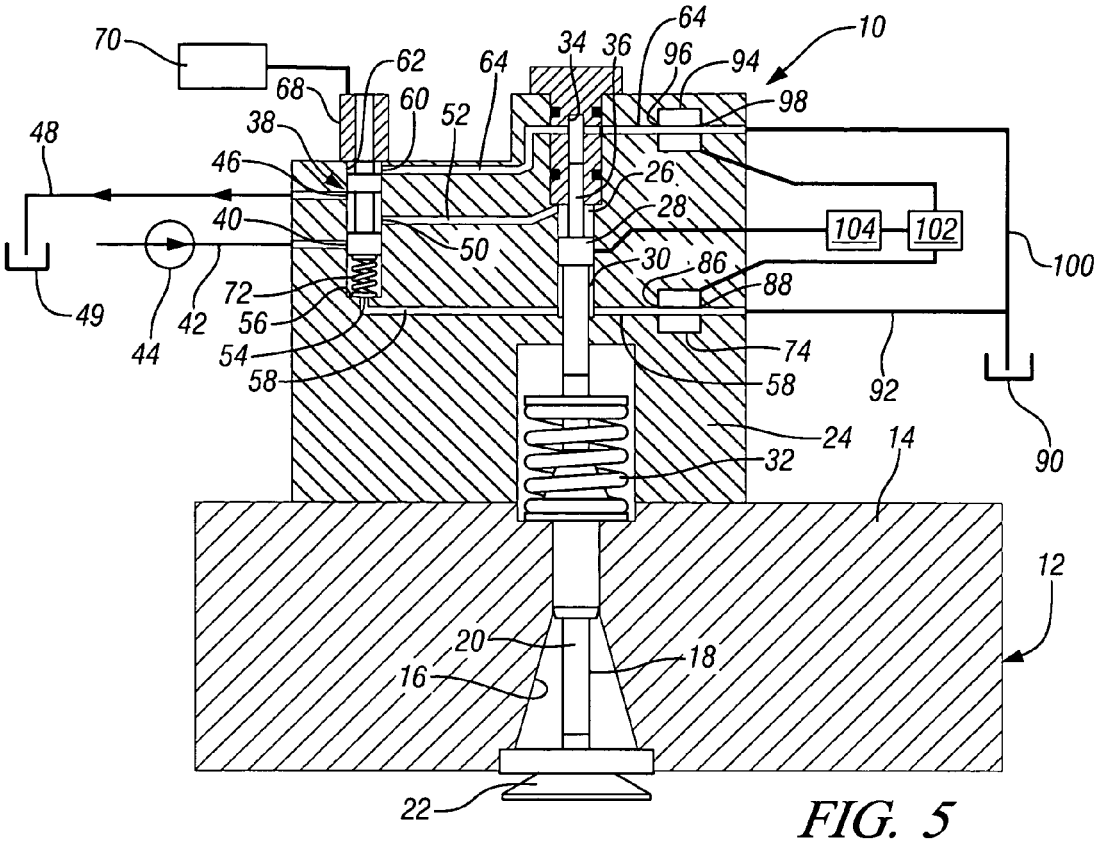
FIG. 5 is a view similar to FIG. 2 in a valve closing position.

To close the engine valve 18, the FPFC 70 de-energizes the actuator 68 and the LC 102 de-energizes the first on/off valve 74. The spool valve spring 72 returns the spool valve 38 to a position which communicates the first chamber 26 with the second intermediate channel 48 and the fluid tank 49. This allows the high pressure fluid in the first chamber 26 to exhaust into the fluid tank 49. The engine valve spring 32 then drives the engine valve 18 upward, as illustrated in FIG. 5. The second fluid chamber and the third fluid chamber 30 and 34 are connected with the tank 90 so that, as the engine valve 18 returns to the closed position, low pressure fluid refills the second fluid chamber from the third fluid chamber and the tank 90.

Figure 6:
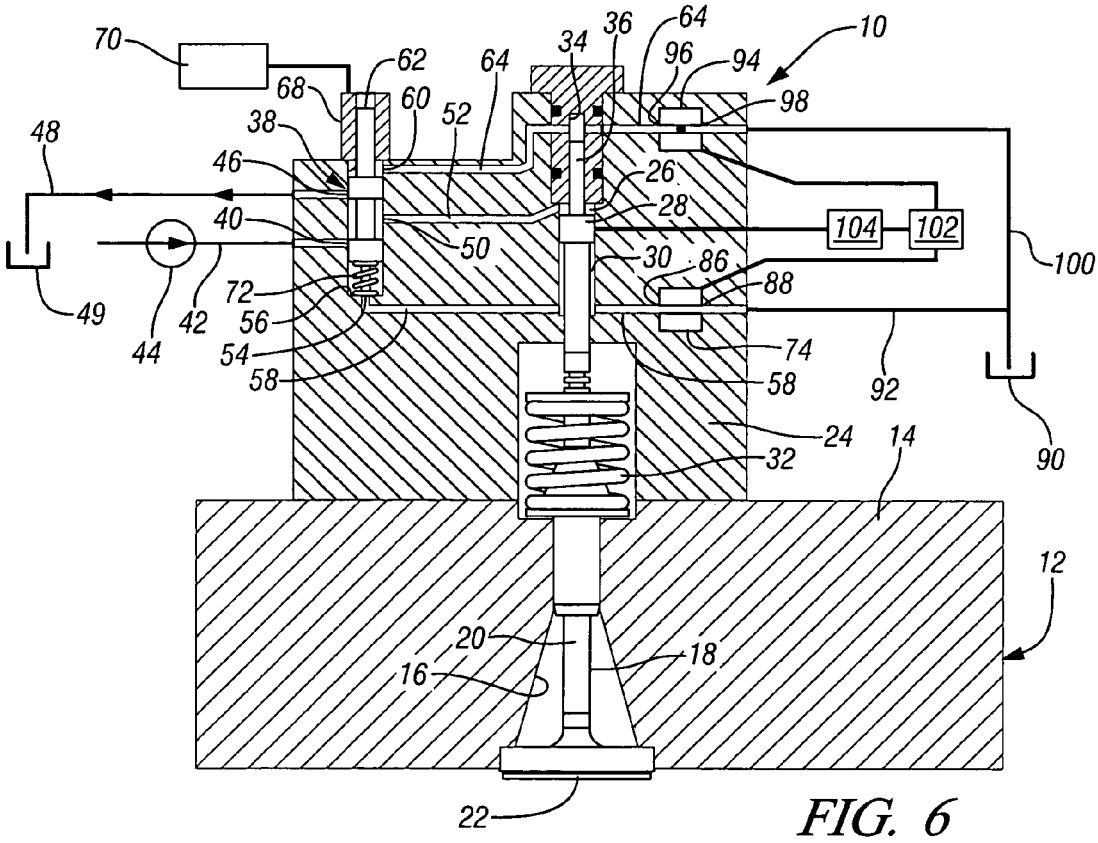
FIG. 6 is a view similar to FIG. 2 in a valve closed position.

As the engine valve 18 nears the closed position, the LC energizes the second on/off valve 94 to activate the second feedback channel 64 to provide a "soft landing". Particularly, as the upward moving engine valve 18 displaces fluid from the third chamber 34 to the second feedback channel 64, the second on/off valve 94 closes to block flow from the third chamber to the fluid tank 90 to create backpressure and increase fluid pressure within the second feedback channel 64 and the fifth chamber 62 of the spool valve 38. The fluid pressure in the fifth chamber 62 drives the spool valve 38 downward against the spool valve spring 72 until the spool valve 38 cuts off or reduces flow through the connection between the driving channel 52 and the intermediate channel 48, as illustrated in FIG. 6. As the spool valve 38 is driven downward, cutting off flow between the driving channel 52 and the intermediate channel 48, the amount fluid flow from the first chamber 26 is reduced, thereby reducing the seating velocity of the engine valve 18. This allows the spool valve spring 72 to return the spool valve to its initial position and the engine valve spring 32 to return the engine valve 18 to the closed position at a controlled velocity.

Figure 7:
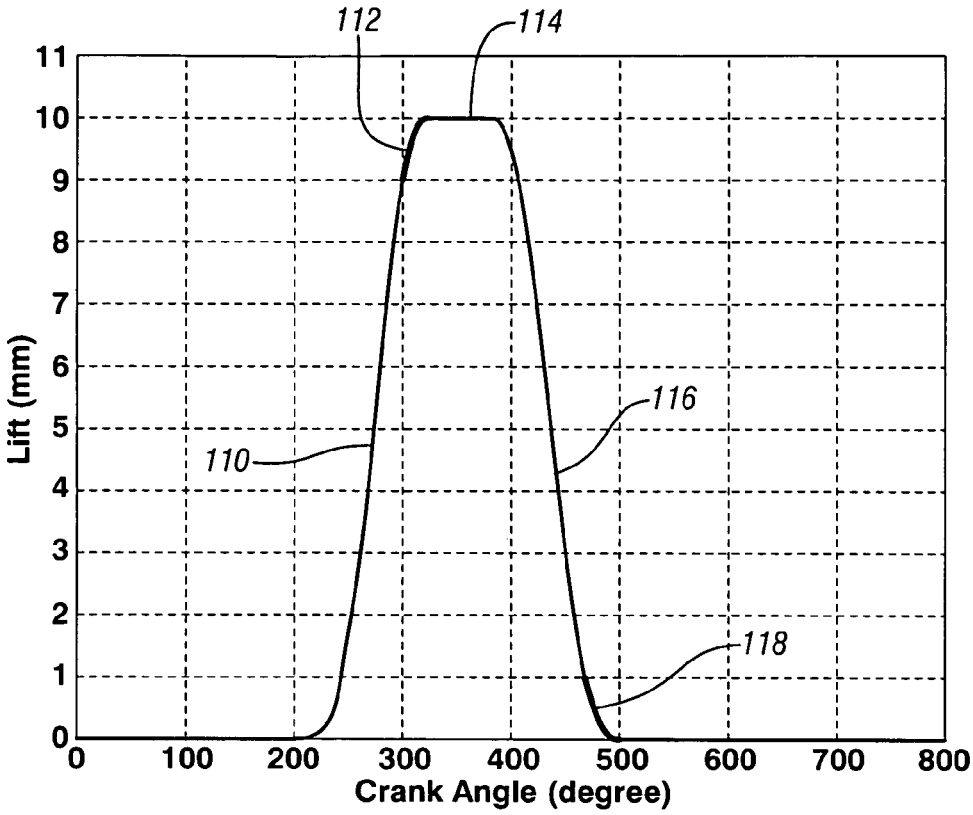
FIG. 7 is a motion valve profile using the valve actuator control of FIG. 1.

FIG. 7 is a graph illustrating the sequence of events during the previously described engine valve cycle. From 0 to 200 degrees of crank angle the engine valve 18 remains closed. At 200 degrees, the FPFC 70 energizes the actuator 68 to actuate the spool valve 38 and initiate an engine valve opening curve 110. At 300 degrees of crank angle the LC energizes the first on/off valve 74 to activate the first feedback channel 58 and reduce the opening velocity of the engine valve 18, as shown by lift deceleration curve 112, until a lift plateau 114 is reached at maximum engine valve lift. The valve remains open on the lift plateau 114 until about 390 degrees when the FPFC 70 de-energizes the spool valve 38 and the LC 102 de-energizes the first on/off valve 74. The engine valve 18 then moves toward a closing position along the closing curve 116. As the engine valve approaches 450 degrees, the LC 102 actuates the second on/off valve 94 to reduce the closing velocity of the engine valve 18, as shown by closing deceleration curve 118, and create a soft landing. As shown, the timing of the first and second on/off valves 74, 94 determines the amount of valve lift and seating velocity of the engine valve 18. Delaying the timing of the first on/off valve 74 increases the amount of valve lift and advancing the timing of the first on/off valve decreases the amount of valve lift. Similarly, delaying the timing of the second on/off valve 94 increases the seating velocity and advancing the timing of the second on/off valve decreases the seating velocity.

Figure 8:
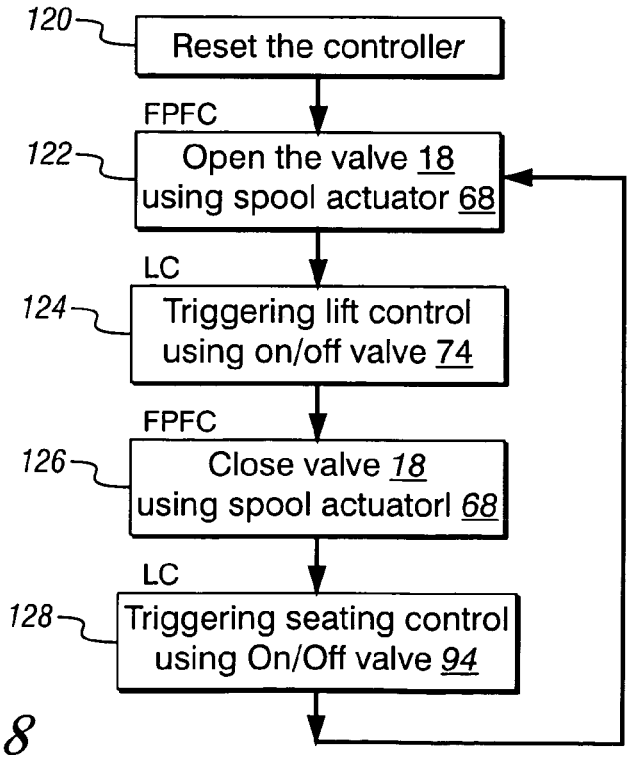
FIG. 8 is a flow chart of a control algorithm utilized by the controller of FIG. 1.

The operation of the FPFC 70 and the LC 102 is further illustrated in the flow chart of FIG. 8. The controls are initially reset to default settings as shown in box 120. The FPFC 70 actuates the spool valve 38 to ramp up the engine valve 18 as shown in box 122. The LC 102 actuates the first on/off valve 74 to reduce the opening velocity of the engine valve 18 and control engine valve lift as shown in box 124. The FPFC 70 actuates the spool valve 38 to close the engine valve 18 as shown in box 126. The LC 102 actuates the second on/off valve 94 to reduce the closing velocity of the engine valve 18 and provide a soft landing of the valve as shown in box 128.

When no engine valve lift error is detected, the triggering timing for the first on/off valve will remain constant. However, when engine valve lift error is detected, the LC 102 calculates the amount of adjustment needed to correct the error and alters the timing of the first on/off valve 74 accordingly.

When no engine valve seating errors are detected, the triggering timing of the second on/off valve will remain constant. However, when engine valve seating error is detected, the LC 102 calculates the amount of adjustment needed to correct the error and alters the timing of the second on/off valve 94 accordingly.

The valve actuator assembly 10 is made open-loop stable by utilizing the hydraulic feedback channels 58 and 64 and the on/off valves 74 and 94 are used to control flow through the feedback channels. Open-loop stability implies that the system's response to a given input signal is not unbounded. The better controllability achieved by open loop stability enables the valve actuator assembly 10 to provide better performance. The valve actuator assembly 10 of the present invention precisely controls the motion of the spool valve 38 though the feedback channels 58 and 64 so that it avoids unnecessary throttling of the low pressure flow and high pressure flow, thereby providing energy consumption benefits.

Figure 9:
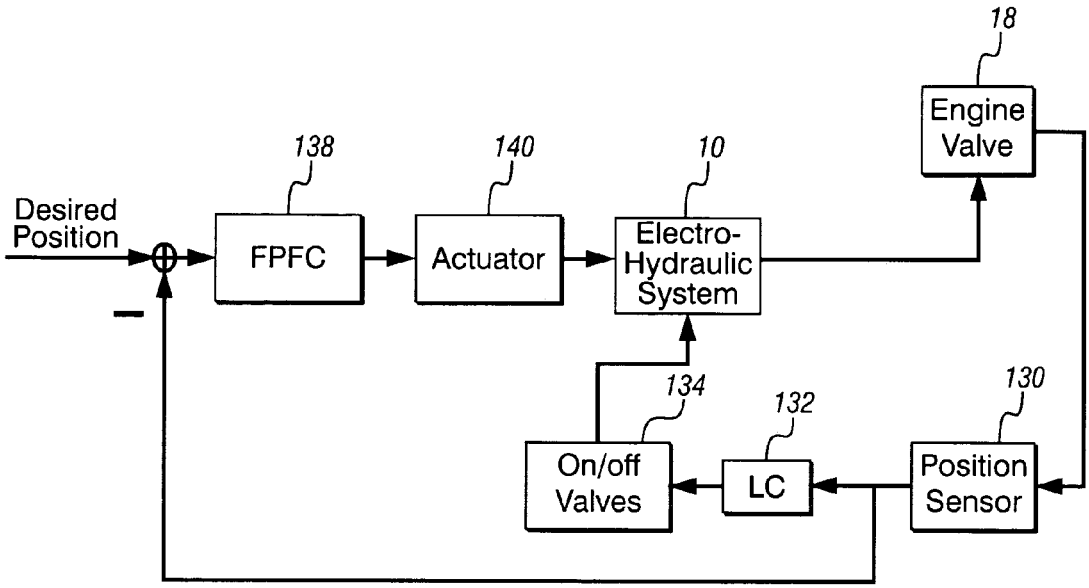
FIG. 9 is a block diagram illustrating a broad arrangement of a valve actuator control according to the present invention.

FIG. 9, illustrates a broad outline of a valve control assembly having an engine valve position sensor 130 interfacing with a LC 132 which further interfaces with on/off valves 134 operative to control feedback channels, not shown. A FPFC 138 interfaces with an actuator 140 to control a spool valve 142 operative to control an engine valve, not shown.

Figure 10:
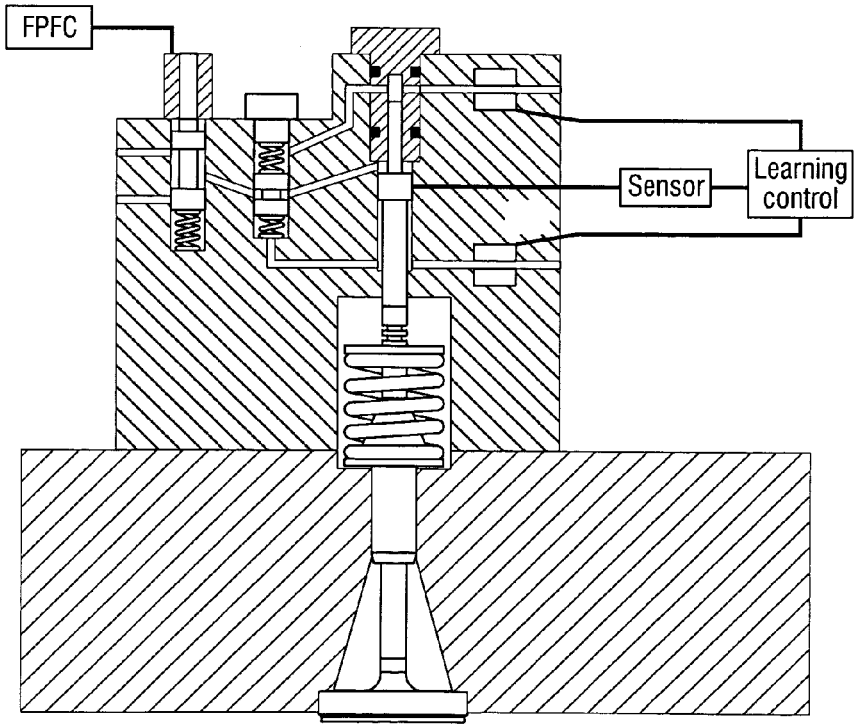
FIG. 10 is a cross-sectional view of an alternative valve actuator assembly.

It should be understood that various other valve control embodiments could also be operated to provide the method of valve motion control broadly described herein. FIG. 10 illustrates one of many possible valve control arrangements which could also incorporate valve motion control including the lift deceleration and soft landing features of the present invention.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. An electrohydraulic valve actuator assembly, comprising:

a movable engine valve;

a movable spool valve;

a spring biasing the engine valve toward a closed position;

a driving channel interconnecting the spool valve and the engine valve;

a first feedback channel interconnecting the engine valve, the spool valve and a first on/off valve;

a second feedback channel interconnecting the engine valve, the spool valve and a second on/off valve;

a feedforward plus feedback control (FPFC) operable to energize and de-energize the spool valve to selectively provide fluid flow to and from the driving channel to position the engine valve between an open position and the closed position; and a learning control (LC) operable to energize and de-energize the first and second on/off valves to selectively enable and disable the feedback channels to control the motion of the spool valve;

an engine valve position locating sensor interfacing with the FPFC and LC and operative to track engine valve lift, closing timing and seating velocity from cycle to cycle;

the LC having a control algorithm to calculate valve positioning error and determine corresponding trigger timings which are relayed to the on/off valves; and the LC adjusting the trigger timing of the on/off valves to alter valve lift, closing timing and seating velocity of the engine valve.

2. A valve actuator assembly as in claim 1 including a valve housing having a first fluid chamber fluidly communicating with the driving channel and a second fluid chamber fluidly communicating with the first feedback channel.

3. A valve actuator assembly as in claim 2 including a first piston operatively cooperating with the engine valve and movably disposed in the valve housing operatively between the first fluid chamber and the second fluid chamber.

4. A valve actuator assembly as in claim 2 wherein the first feedback channel interconnects the second fluid chamber and a fourth fluid chamber of the spool valve.

5. A valve actuator assembly as in claim 2 wherein the valve housing has a third fluid chamber fluidly communicating with the second feedback channel.

6. A valve actuator assembly as in claim 5 including a second piston operatively cooperating with the engine valve and disposed in the valve housing, one side of the second piston being open to a third fluid chamber.

7. A valve actuator assembly as in claim 6 wherein the second feedback channel interconnects the third fluid chamber with a fifth fluid chamber of the spool valve.

8. A valve actuator assembly as in claim 1 including a fourth fluid chamber at one end of the spool valve and fluidly communicating with the first feedback channel and a fifth fluid chamber at an opposite end of the spool valve and fluidly communicating with the second feedback channel.

9. A valve actuator assembly as in claim 8 including a first spool valve spring biasing the spool toward the fifth fluid chamber.

10. A method of controlling internal feedback channels of an electrohydraulic valve actuator assembly to alter engine valve lift, seating velocity and closing timing, comprising the steps of:

providing an electrohydraulic valve train having a first feedback channel operable to maintain a desired valve lift and a second feedback channel operable to initiate soft valve seating;

providing a controller operable to monitor actual valve lift position, seating position and seating velocity and interfacing with first and second on/off valves for triggering the feedback channels;

determining the actual valve lift position, seating position and seating velocity and relaying the valve lift position, seating position and seating velocity in the controller;

comparing the actual valve lift position, seating position and seating velocity to a desired valve lift position, seating position and seating velocity in the controller to determine valve lift error, seating position error and seating velocity error and, converting the error into feedback trigger timing to correct error; and varying the trigger timing of the feedback channels with the control to compensate for error and operate the engine valve with desired valve lift, seating position and seating velocity parameters.

* * * * *